US008870581B2

(12) United States Patent
Chang

(10) Patent No.: US 8,870,581 B2
(45) Date of Patent: Oct. 28, 2014

(54) SOCKET MODULE OF ELECTRICAL CONNECTOR

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 68 days.

(21) Appl. No.: 13/723,863

(22) Filed: Dec. 21, 2012

(65) Prior Publication Data

US 2013/0183840 A1 Jul. 18, 2013

(30) Foreign Application Priority Data

Jan. 18, 2012 (TW) ..... 101201148 A

(51) Int. Cl.

| | |
|---|---|
| ***H01R 13/648*** | (2006.01) |
| ***H01R 13/658*** | (2011.01) |
| *H01R 24/62* | (2011.01) |
| *H01R 12/72* | (2011.01) |

(52) U.S. Cl.

CPC ..... *H01R 13/648* (2013.01); *H01R 24/62* (2013.01); *H01R 12/724* (2013.01); *H01R 13/65802* (2013.01)

USPC ..... 439/96

(58) Field of Classification Search

USPC ..... 439/96, 541.5, 540.1, 607.15, 607.01, 439/701

See application file for complete search history.

(56) References Cited

U.S. PATENT DOCUMENTS

| | | | | |
|---|---|---|---|---|
| 6,132,254 | A * | 10/2000 | Wu | 439/607.19 |
| 6,319,061 | B1 * | 11/2001 | Chen et al. | 439/607.15 |
| D465,765 | S * | 11/2002 | Zhang et al. | D13/147 |
| 8,043,107 | B2 * | 10/2011 | He | 439/352 |
| 8,591,258 | B2 * | 11/2013 | Xiao et al. | 439/607.25 |
| 2006/0183371 | A1 * | 8/2006 | Tsai | 439/541.5 |
| 2010/0035465 | A1 * | 2/2010 | Wang | 439/541.5 |
| 2010/0035466 | A1 * | 2/2010 | Lee et al. | 439/541.5 |
| 2010/0093208 | A1 * | 4/2010 | Hamner et al. | 439/541.5 |

* cited by examiner

*Primary Examiner* — Alexander Gilman

(74) *Attorney, Agent, or Firm* — Chun-Ming Shih; HDLS IPR Services

(57) ABSTRACT

A socket module of electrical connector includes a first socket, a second socket arranged in a row with the first socket, and an electric conduction elastic piece. The first socket includes a first terminal base and a first ground piece circumferencing the first terminal base. The second socket includes a second terminal base and a second ground piece circumferencing the second terminal base. The electric conduction elastic piece contacts and electrically connects the first ground piece and the second ground piece.

8 Claims, 5 Drawing Sheets

SOCKET MODULE OF ELECTRICAL CONNECTOR

This application is based on and claims the benefit of Taiwan Application No. 101201148 filed Jan. 18, 2012 the entire disclosure of which is incorporated by reference herein.

BACKGROUND

1. Technical Field

The present application relates to a socket module of electrical connector, particularly to a socket module of electrical connector where a plurality of connector outer cases electrically connecting to the ground.

2. Related Art

The multi-connector module used on a computer or an electrical device is usually assembled with a plurality of connectors and fixed with plastic base. Each connector has its own ground piece which is usually an iron case of the connector. However, the uneven grounding happens when each connector does the grounding individually. In order to solve this problem, the common method is covering another iron made outer case on the multi-connector module, and then electrically connects each connector to the iron made outer case in order to achieve even grounding, yet installing the iron made outer case also increases the cost of the multi-connector module.

BRIEF SUMMARY

The present application provides a socket module of electrical connector. By installing an electric conduction elastic piece evenly grounding inside the socket module, covering an iron case over the outer surface of the socket module is no longer necessary.

The socket module of electrical connector according to the present application includes a first socket, a second socket arranged in a row with the first socket, and an electric conduction elastic piece. The first socket includes a first terminal base and a first ground piece circumferencing the first terminal base. The second socket includes a second terminal base and a second ground piece circumferencing the second terminal base. The electric conduction elastic piece is disposed between the first ground piece and the second ground piece, and contacts and electrically connects the first ground piece and the second ground piece.

The present application electrically connects the first ground piece and the second ground piece by the electric conduction elastic piece, and then further electrically connects the second ground piece to the ground, thereby achieving the effect of even grounding for the first socket and the second socket, and also overcomes the high cost drawback of the conventional technique that covers iron case over the socket module.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
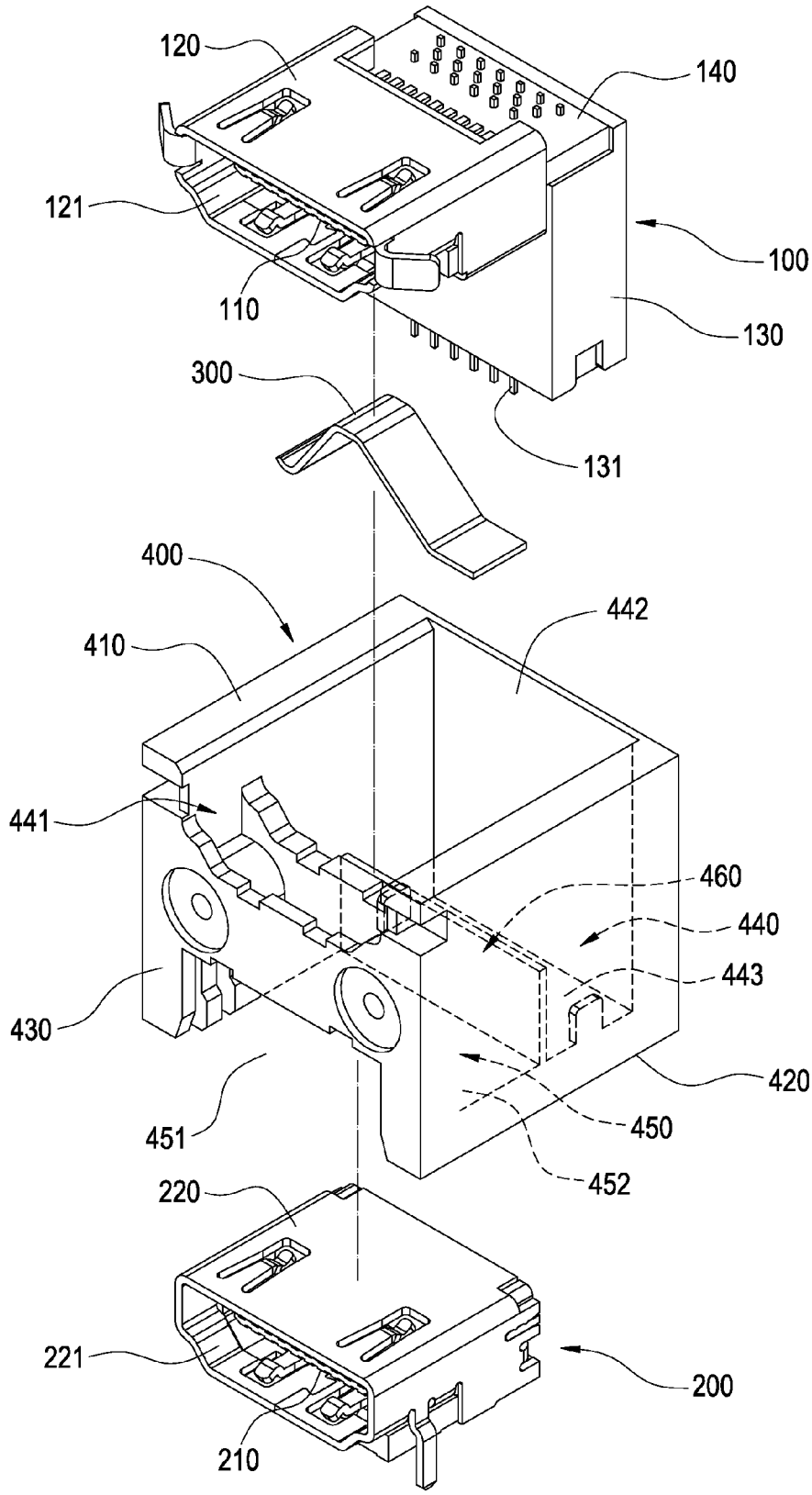
FIG. 1 is an exploded perspective view of an electrical connector socket module of the first embodiment according to the present application.
Figure 2:
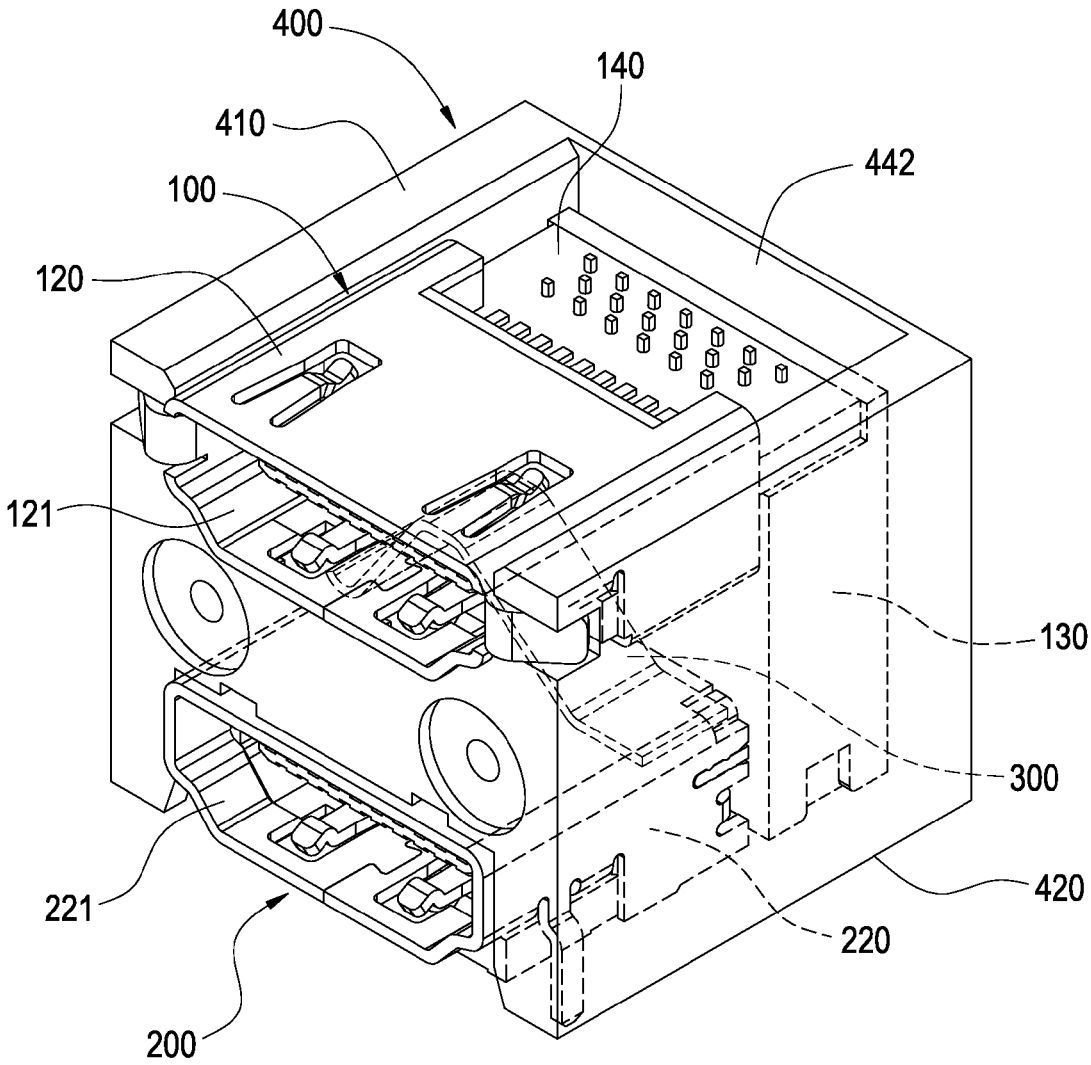
FIG. 2 is an exterior schematic view of the electrical connector socket module of the first embodiment according to the present application.

Please refer to FIGS. 1 and 2, a first embodiment provides an electrical connector socket module which includes a first socket 100, a second socket 200, an electric conduction elastic piece 300, and an insulating base 400.

Figure 3:
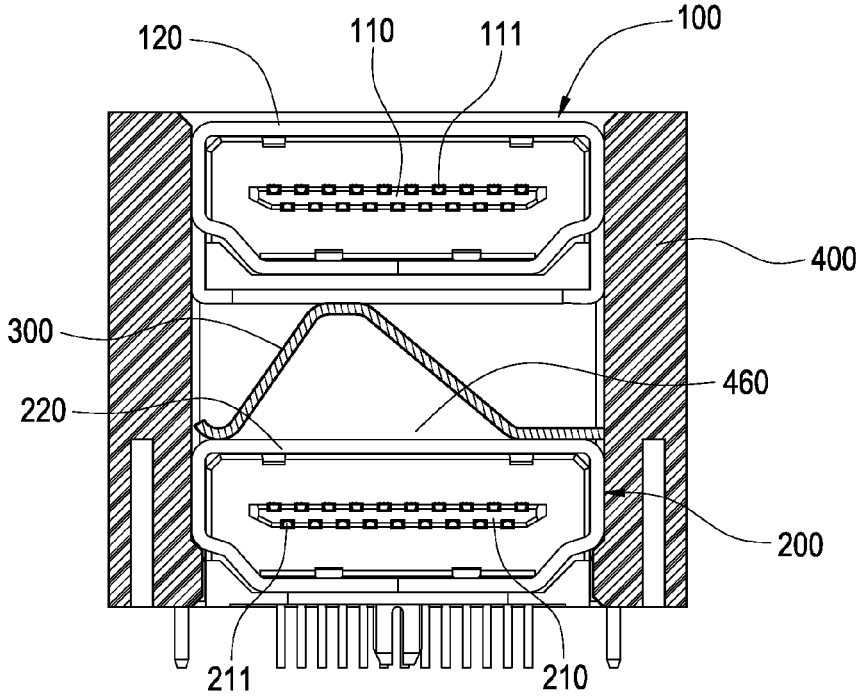
FIG. 3 is a first sectional view of the electrical connector socket module of the first embodiment according to the present application.

Please refer to FIGS. 1 and 3, the first socket 100 includes a first terminal base 110, a first ground piece 120, an extension member 130, and a circuit board 140. The first terminal base 110 is made of plastic, and a plurality of first terminals 111 are embedded therein. The first ground piece 120 includes a tubular shell with two open ends formed by bending a metal sheet. One end of the first ground piece 120 may be a first receiving port 121 for receiving a corresponding connector plug. The first terminal base 110 is axially inserted into the first ground piece 120 through the other end. The extension member 130 is a column made of plastic, and a plurality of extension terminals 131 are embedded therein. The extension member 130 is arranged vertically to the first ground piece 120. The circuit board 140 electrically connects the first terminals 111 of the first terminal base 110 and the extension terminals 131 of the extension member 130.

The second socket 200 and the first socket 100 are arranged in a row. The second socket 200 includes a second terminal base 210 and a second ground piece 220. The second terminal base 210 is made of plastic, and a plurality of second terminals 211 are embedded therein. The second terminal 211 is vertical to the second ground piece 220 and protrudes from the second terminal base 210. The second ground piece 220 is a tubular shell with two open end formed by bending a metal sheet. One end of the second ground piece 220 is a second receiving port 221 for receiving a corresponding connector plug. The second terminal base 210 is axially inserted into the second ground piece 200 through the other end. The second ground piece 220 electrically connects the ground.

Figure 4:
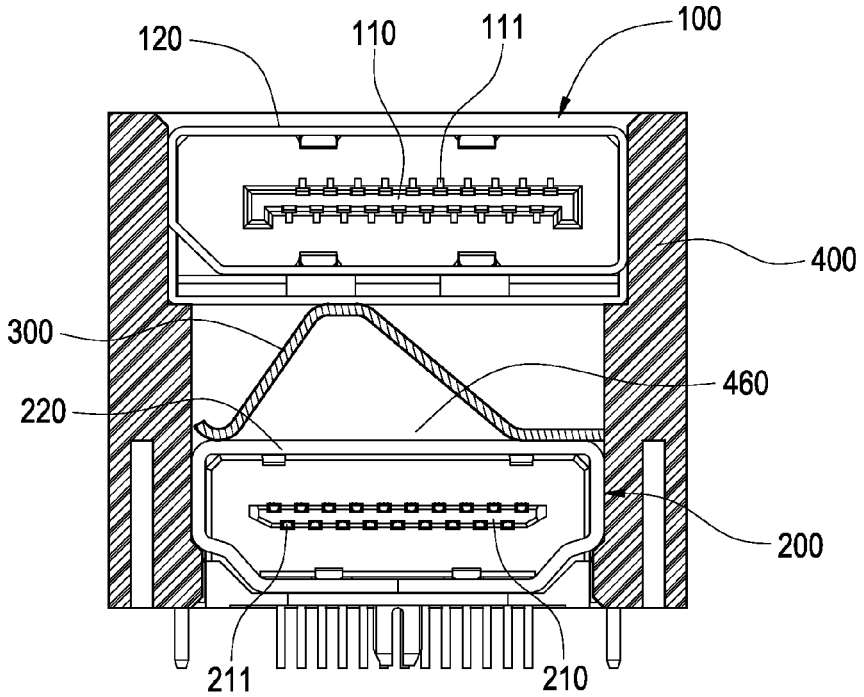
FIG. 4 is a second sectional view of the electrical connector socket module of the first embodiment according to the present application.

Please refer to FIG. 3, preferably, the first socket 100 and the second socket 200 are the same specification. For example, both of the first socket 100 and the second socket 200 are HDMI format in the present embodiment, but not limited thereto. The specification of the first socket 100 and the second socket 200 can also not be the same. For example, as shown in FIG. 4, the first socket 100 is Displayport (DP) format, while the second socket 200 is HDMI format.

Preferably, the electric conduction elastic piece 300 is a long strip metal sheet bent to form an included angle (preferably an obtuse angle). The electric conduction elastic piece 300 is disposed between and electrically connects the first ground piece 120 and the second ground piece 220. Since the second ground piece 220 has already electrically connected to the ground, the first ground piece 120, the second ground piece 220, and the ground are all in a same electric potential.

Please refer to FIGS. 1 and 2, the insulating base 400 is preferably a plastic six-sided cube which includes a top surface 410, a bottom surface 420, and a front side surface 430 which connects the top surface 410 and the bottom surface 420. The insulating base 400 is provided with a first accommodation space 440, a second accommodation space 450, and a connection port 460. The first accommodation space 440 has a first opening 441 provided on the front side surface 430, an installation port 442 provided on the top surface 410, and a first welding port 443 provided on the bottom surface 420. The second accommodation space 450 has a second opening 451 provided on the front side surface 430 and the second opening 451 is side by side with the first opening 441. The second accommodation space 450 also has a second welding port 452 provided on the bottom surface 420, and the second welding port 452 is also side by side with the first welding port 443. The aforementioned first socket 100 and the electric conduction elastic piece 300 are placed in the first accommodation space 440 via the installation port 442, and the first receiving port 121 is exposed to the front side surface 430 via the first opening 441, and the extension terminal 131 is also exposed to the bottom surface 420 via the first welding port 443. The aforementioned second socket 200 is placed in the second accommodation space 450; the second receiving port 221 is exposed to the front side surface 430 via the second opening 451, and the second receiving port 221 is side by side with the first receiving port 121. The portion extruding from the second terminal base 210 of the second terminal 211 is exposed to the bottom surface 420 via the second welding port 452. The connection port 460 is disposed between and connects the first accommodation space 440 and the second accommodation space 450, and thereby the electric conduction elastic piece 300 accommodated in the first accommodation space 440 contacts and electrically connects the first ground piece 120 and the second ground piece 220 via the connection port 460, which achieves the even grounding effect by the electric conduction elastic piece 300.

Figure 5:
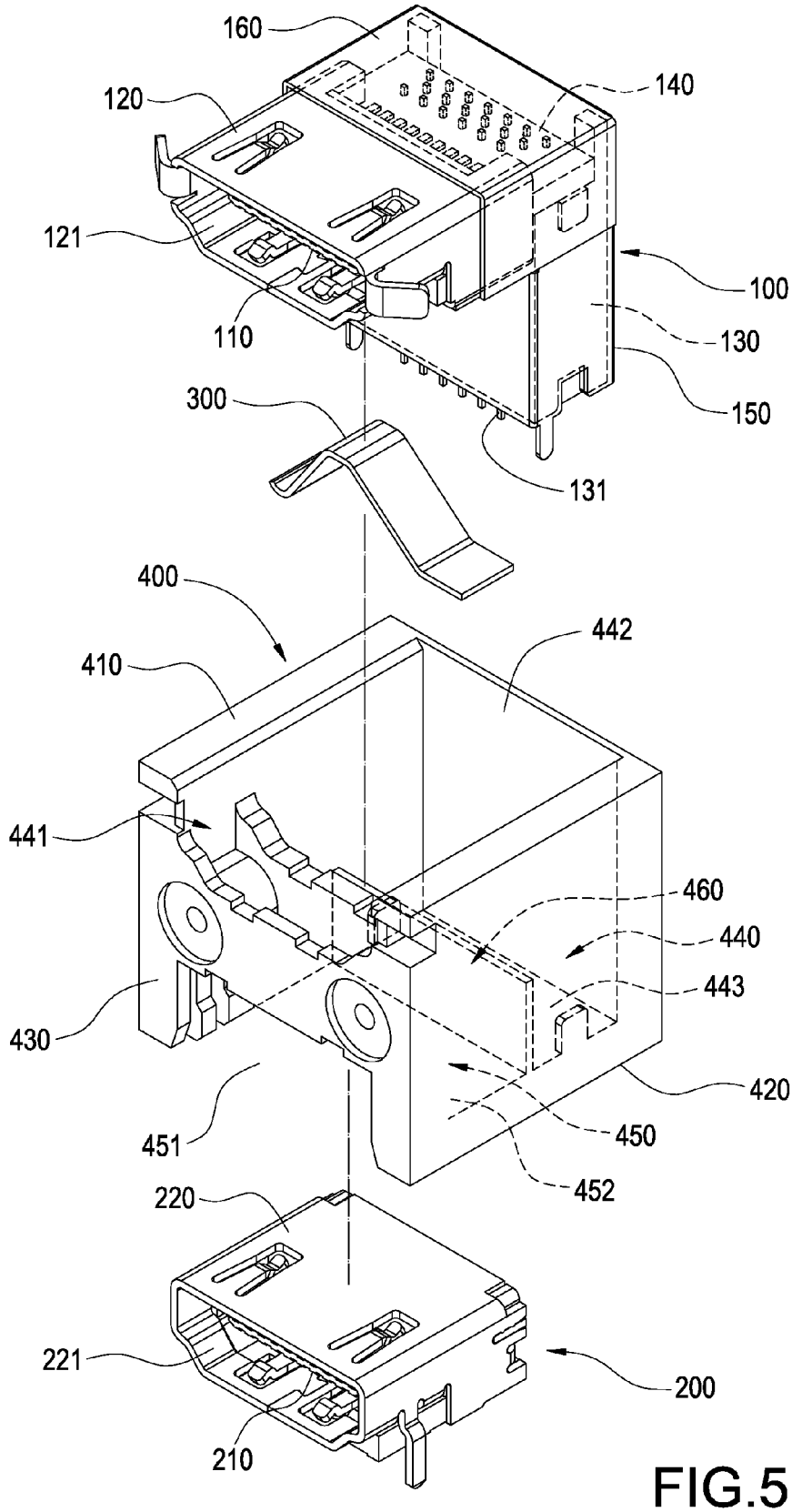
FIG. 5 is an exploded perspective view of the electrical connector socket module of the second embodiment according to the present application.
Figure 6:
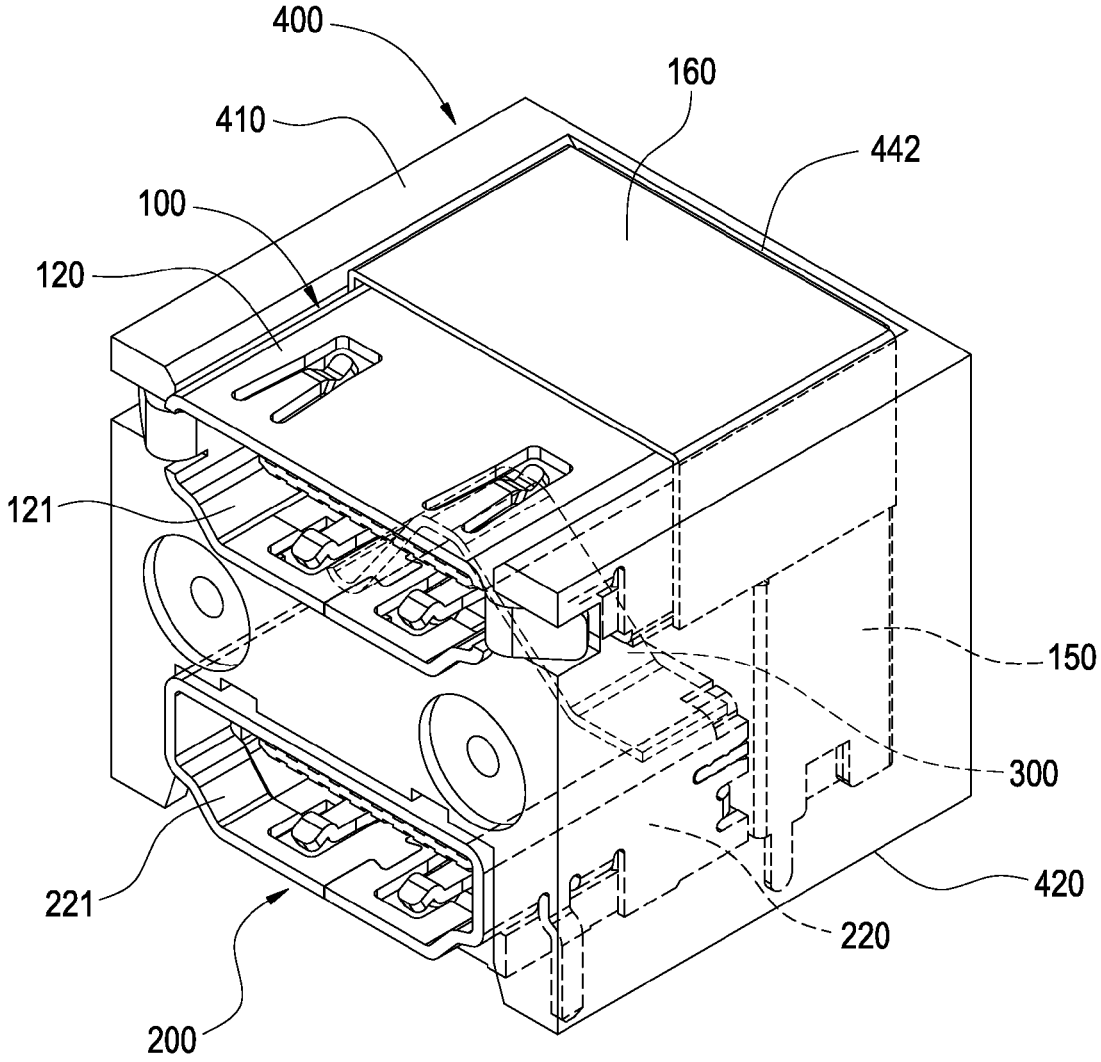
FIG. 6 is an exterior schematic view of the electrical connector socket module of the second embodiment according to the present application.

Please refer to FIGS. 5 and 6, a second embodiment also provides an electrical connector socket module, which includes a first socket 100, a second socket 200, an electric conduction elastic piece 300, and an insulating base 400.

In the present embodiment, the structure, function, and the connecting relations are approximately the same as the first embodiment. The difference compared to the first embodiment lies in that the first socket 100 further includes a metal outer case 150 and a metal cover 160. The metal outer case 150 is preferably a rectangular tubular shell formed by bending a metal sheet. The metal outer case 150 covers the outside of the extension member 130 to isolate the electric magnetic interference. The metal cover 160 is preferably an U shape cover formed by bending a metal sheet. The metal cover 160 covers the circuit board 140 of the first socket 100 to isolate the electric magnetic interference. After placing the first socket 100 mentioned above in the insulating base 400 via the installation port 442, the metal cover 160 is exposed to the top surface 410 of the insulating base 400 via the installation port 442. In the present embodiment, preferably, the metal cover 160 can be integrated with the metal outer case 150, which means the metal cover 160 and the metal outer case 150 can be formed by bending a same piece of metal sheet, and thus lessens the processing steps.

The present application electrically connects the first ground piece 120 and the second ground piece 220 by the electric conduction elastic piece 300, and then further electrically connects the second ground piece 220 to the ground, thereby achieving the effect of even grounding of the first socket 100 and the second socket 200. Compared to the conventional technique that covers the whole multi-connector module with iron case and electrically connects each connector, the present application reduces lots of metal usage, and thus costs fewer when in manufacturing as well.

Although the present application has been described with reference to the foregoing preferred embodiments, it will be understood that the application is not limited to the details thereof. Various equivalent variations and modifications can still occur to those skilled in this art in view of the teachings of the present application. Thus, all such variations and equivalent modifications are also embraced within the scope of the application as defined in the appended claims.

What is claimed is:

1. A socket module of electrical connector, comprising:

a first socket including a first terminal base and a first ground piece circumferencing the first terminal base;

a second socket including a second terminal base and a second ground piece circumferencing the second terminal base, the second socket and the first socket arranged in a row;

an electric conduction elastic piece disposed between the first ground piece and the second ground piece, and the electric conduction elastic piece contacting and electrically connecting the first ground piece and the second ground piece; and an insulating base providing a first accommodation space for accommodating the first socket and the electric conduction elastic piece, a second accommodation space for accommodating the second socket, and a connection port disposed between the first accommodation space and the second accommodation space, and the connection port connecting the first accommodation space and the second accommodation space, the electric conduction elastic piece electrically connecting the first ground piece and the second ground piece via the connection port.

2. The socket module according to claim 1, wherein the second ground piece electrically connects a ground.

3. The socket module according to claim 1, wherein the first ground piece comprises a first receiving port, and the second ground piece comprises a second receiving port, the first receiving port and the second receiving port are arranged in a row.

4. A socket module of electrical connector, comprising:

a first socket including a first terminal base and a first ground piece circumferencing the first terminal base;

a second socket including a second terminal base and a second ground piece circumferencing the second terminal base, the second socket and the first socket arranged in a row; and an electric conduction elastic piece disposed between the first ground piece and the second ground piece, and the electric conduction elastic piece contacting and electrically connecting the first ground piece and the second ground piece, wherein the first socket comprises an extension member being vertical to the first ground piece, and a circuit board connects the first terminal base and the extension member.

5. The socket module according to claim 4, wherein the first socket comprises a metal cover covering the circuit board.

6. The socket module according to claim 5, wherein the first socket comprises a metal outer case covering the extension member.

7. The socket module according to claim 6, wherein the metal outer case and the metal cover are integrated in one piece.

8. The socket module according to claim 4, wherein the first socket comprises a plurality of first terminals and a plurality of extension terminals, the first terminals are embedded inside the extension terminals, and the circuit board electrically connects to the first terminals and the extension terminals.

* * * * *